United States Patent [19]

Mastrodicasa

[11] Patent Number: 4,658,968

[45] Date of Patent: Apr. 21, 1987

[54] ADJUSTABLE BRACKET ASSEMBLY FOR SUPPORTING A SHELF

[76] Inventor: Arthur R. Mastrodicasa, 5 Elmcrest Cir., Walpole, Mass. 02081

[21] Appl. No.: 860,836

[22] Filed: May 8, 1986

Related U.S. Application Data

[63] Continuation of Ser. No. 752,516, Jul. 8, 1985, abandoned, which is a continuation-in-part of Ser. No. 593,665, Mar. 26, 1984, abandoned, which is a continuation-in-part of Ser. No. 667,448, Nov. 1, 1984, abandoned.

[51] Int. Cl.[4] ..... A47G 29/02

[52] U.S. Cl. ..... 211/187; 248/250; 211/153

[58] Field of Search ..... 248/250, 241, 187, 235, 248/310, 243, 242; 108/108; 211/134, 186, 187, 153; 403/328

[56] References Cited

U.S. PATENT DOCUMENTS

| | | | |
|---|---|---|---|
| 710,780 | 10/1902 | Hutchens | 248/242 |
| 826,321 | 7/1906 | Eustis | 248/250 |
| 1,176,588 | 3/1916 | Miller et al. | 248/250 |
| 1,230,999 | 6/1917 | Crist | 248/250 |
| 1,702,937 | 2/1929 | Friedeman | 248/250 X |
| 1,779,236 | 10/1930 | Hoegger . | |
| 2,136,109 | 11/1938 | Kress | 248/242 X |
| 3,321,089 | 5/1967 | Krikorian | 211/134 |
| 3,353,684 | 11/1967 | Chesley | 211/176 |
| 3,355,134 | 11/1967 | Chesley | 248/250 |
| 3,565,381 | 2/1971 | Oliver | 248/243 |
| 4,518,002 | 5/1985 | Battison, Sr. et al. | 403/85 X |

FOREIGN PATENT DOCUMENTS

| | | | |
|---|---|---|---|
| 601775 | 7/1960 | Canada | 108/108 |
| 299250 | 6/1962 | France | 248/250 |
| 414757 | 8/1934 | United Kingdom | 248/241 |
| 499715 | 1/1939 | United Kingdom | 248/243 |

*Primary Examiner*—Ramon S. Britts
*Assistant Examiner*—Karen J. Chotkowski
*Attorney, Agent, or Firm*—Scott R. Foster

[57] ABSTRACT

A bracket assembly for supporting a shelf, the assembly including a bracket member, a first slide member having a first notch thereon, the first slide member being slidably mounted on the bracket member, a second slide member having a second notch thereon, the second slide member being slidably mounted on the bracket member such that the second notch is opposed to the first notch, the first and second notches being adapted to receive and retain shelving therebetween, and lock means for locking the first and second slide members in selected positions on the bracket member.

1 Claim, 6 Drawing Figures

ADJUSTABLE BRACKET ASSEMBLY FOR SUPPORTING A SHELF

CROSS-REFERENCE TO RELATED APPLICATIONS

This is a continuation of now abandoned application Ser. No. 752,516, filed July 8, 1985, which was a continuation-in-part of now abandoned application Ser. No. 593,665, filed Mar. 26, 1984, and a continuation-in-part of now abandoned Ser. No. 667,448, filed Nov. 1, 1984, in the name of Arthur R. Mastrodicasa.

BACKGROUND OF THE INVENTION

This invention relates to shelf-supporting devices and is directed more particularly to an adjustable bracket assembly adapted to securely support shelving of various sizes and configurations.

DESCRIPTION OF THE PRIOR ART

Shelf-supporting brackets of the type finding utility in retail outlets are generally well known, and various embodiments are adapted to operate under given conditions.

U.S. Pat. No. 3,321,089, issued May 23 1967 to G. Krikorian is illustrative of a shelf-supporting bracket comprising an arm having notches therein suited for receiving flexible wires of a wire shelf. Other examples of bracket adapted for use with wire shelving include U.S. Pat. No. 3,355,134, issued Nov. 28, 1967 to R. G. Chesley, and U.S. Pat. No. 3,565,381, issued Feb. 23, 1971 to Earl J. Oliver, both of which show the use of fasteners, or clamps, on bracket members to secure wire portions of shelving thereto. The fasteners may be moved about upon brackets to provide for adjustability and thereby attain a degree of usefulness not found in the Krikorian device.

Other embodiments of adjustable shelf supports are found in U.S. Pat. No. 1,702,937, issued Feb. 19, 1929 to M. M. Friedemann, and U.S. Pat. No. 1,779,236, issued Oct. 21, 1930 to J. A. Hoegger.

In Friedemann, a slide member is mounted on a bracket arm and used in conjunction with an "angle member" to squeeze opposite edges of a shelf therebetween. The bracket arm and angle member are both mounted upon a vertical standard. In Hoegger, a shelf supporting arm has a notch on its upper edge, and a spring-biased extension protruding from the free end thereof, the extension having a notch opposed to the arm notch, such that a shelf may be gripped at opposite edges by the two notches, under a spring bias. Neither Friedemann nor Hoegger is directed specifically to wire shelving.

In U.S. patent application Ser. No. 593,665, filed Mar. 26, 1984, in the name of Arthur R. Mastrodicasa, there is disclosed an adjustable bracket assembly for use with wire shelving in which the wire members are substantially rigid. The assembly includes an arm, a slide member slidably mounted on the arm, and a lock means for locking the arm and slide member in a selected position suitable for a selected shelf. The assembly is capable of use independently of additional fastening structures, such as angle members, clamps, and the like.

In U.S. patent application Ser. No. 667,448, filed Nov. 1, 1984, in the name of Arthur R. Mastrodicasa, there is disclosed an alternative adjustable bracket assembly for use with wire shelving. The assembly covered by the '448 application also includes an arm, a slide member slidably mounted on the arm, and a lock means for locking the arm and slide member in a selected position suitable for a selected shelf. As with the '665 assembly, the '448 assembly is capable of use independently of additional fastening structures, such as angle members, clamps, and the like. In the '448 application there is disclosed an adjustable bracket assembly of thee type disclosed in the '665 application, but providing an alternative structure having a greater range of adjustability.

SUMMARY OF THE INVENTION

An object of the present invention is to provide an adjustable bracket assembly of the type disclosed in the aforesaid '665 and '448 applications, but providing an alternative structure having a greater range of adjustability.

Another object of the invention is to provide such an assembly which, though adjustable, is completely secure in its shelf-retaining function.

A further object of the invention is to provide such an assembly which, though strong and durable, is readily manufactured inexpensively and which, in the market place, is easy and safe to use.

With the above and other objects in view, as will hereinafter appear, a feature of the present invention is the provision of a bracket assembly for supporting a shelf, the assembly comprising a bracket member, a first slide member mounted on the bracket member, the first slide member having means thereon defining a first notch, the first notch defining means being adapted to receive and overlie a first shelf portion, a second slide member mounted on the bracket member, the second slide member having means thereon defining a second notch, the second notch defining means being adapted to receive and overlie a second shelf portion, the second notch being opposed to and in alignment with the first notch, the first and second slide members being slidably moveable on the bracket member, a first lock means for securing the first slide member in a selected fixed position on the bracket member, a second lock means for securing the second slide member in a selected fixed position on the bracket member, the bracket member being provided with an elongated slot extending lengthwise thereof, each of the first and second lock means including a reciprocally moveable and spring biased pin extending from its respective slide member and through the slot, a portion of each of the pins being adapted to be biased into position to lock its respective slide member in a selected position on the bracket member.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention from which its novel features and advantages will be apparent.

In the drawings.

DESCRIPTION OF THE PREFERRED EMBODIMENT

Figure 1:
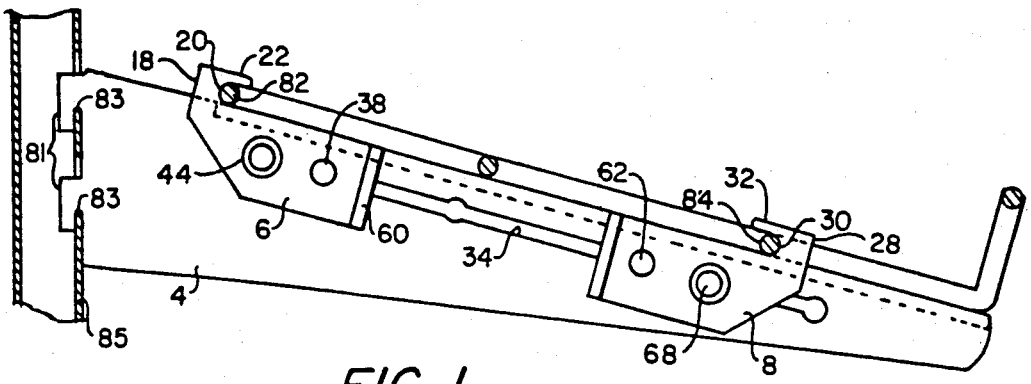
FIG. 1 is a right side elevational view of one form of bracket assembly illustrative of an embodiment of the invention, shown in combination with an upright support and wire shelf, the latter elements shown in section for clarity.

Referring to the drawings, it will be seen that the illustrative bracket assembly 2 includes a bracket member 4, a first slide member 6 mounted on the bracket member, and a second slide member 8 mounted on the bracket member. The bracket member 4 comprises a rigid, elongated, substantially planar member, preferably of metal.

Figure 2:
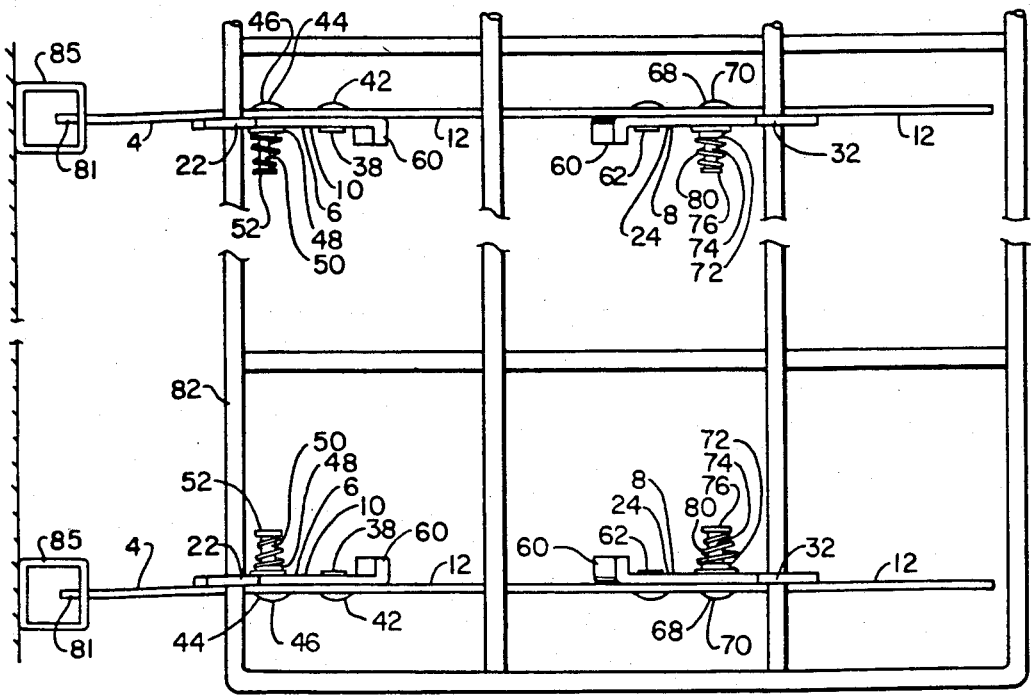
FIG. 2 is a top plan view of the elements shown in FIG. 1.
Figure 3:
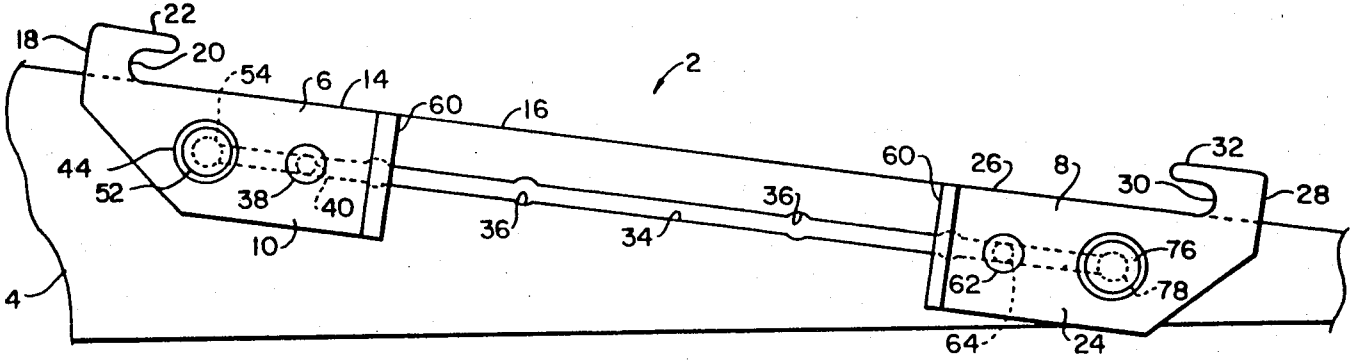
FIG. 3 is an enlarged right side elevational view of the bracket assembly.

The first slide member 6 (FIG. 3) comprises a rigid, elongated member, preferably of metal, having a planar portion 10 (FIG. 2) disposed adjacent a planar surface 12 of the bracket member 4 and slidable thereon. The first slide member 6 is provided with an edge 14 disposed coincidentally with a bracket member lengthwise edge 16 (FIGS. 2 and 3). A first hook portion 18 extends outwardly from the first slide member edge 14 and forms a first notch 20. The first hook portion 18 is provided with a first leg portion 22 adapted to overlie a shelf first portion.

The second slide member 8 (FIG. 3) comprises a rigid, elongated member, preferably of metal, having a planar portion 24 (FIG. 2) disposed adjacent the planar surface 12 of the bracket member 4 and slidable thereon. The second slide member 8 is provided with an edge 26 disposed coincidentally with the bracket member edge 16 (FIGS. 2 and 3). A second hook portion 28 extends outwardly from the second slide member edge 26 and forms a second notch 30. The second hook portion 28 is provided with a second leg portion 32 adapted to overlie a shelf second portion. The second hook portion 28 is substantially aligned with and opposed to the first hook portion 18. The first and second notches 20, 30 are thus in alignment with each other and opposed.

Figure 4:
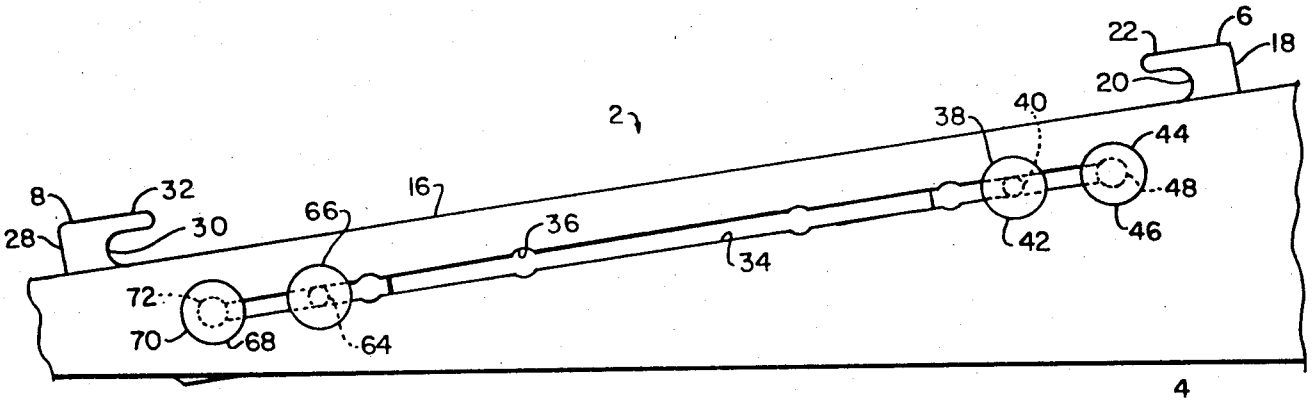
FIG. 4 is an enlarged left side elevational view of the bracket assembly.

The bracket member 4 is provided with opening means, preferably in the form of an elongated slot 34, having enlarged portions 36 disposed along the length thereof. Six such portions are shown in FIGS. 3 and 4, but any desired number of such enlarged portions may be incorporated in the slot 34. A first pin 38 (FIG. 3) is fixed to the first slide member 6, a shank portion 40 of the first pin 38 extending through the slot 34. The first pin 38 is provided with a head 42 (FIG. 4) larger than the width of the slot 34, to retain in a slidable mode the slide member 6 upon the bracket member surface 12.

Figure 5:
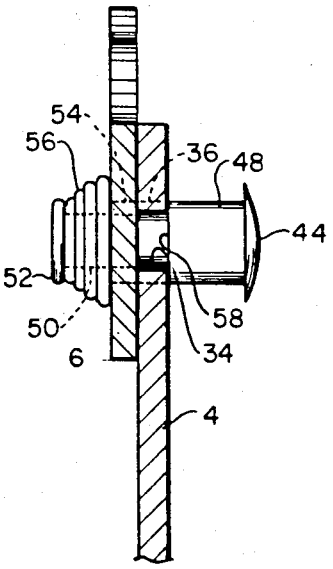
FIG. 5 is a sectional view of an illustrative lock means, shown in one position.

A second pin 44 is mounted for reciprocal movement in the assembly and includes a first enlarged head 46, a first enlarged shank portion 48, a second shank portion 50, and a second enlarged head 52. The second pin second shank portion 50 is disposed in a hole 54 in the first slide member 6. The second pin first enlarged shank portion 48 is larger in diameter than the width of the slot 34, but slightly smaller than the enlarged portions 36 of the slot 34. The second shank portion 50 of the pin 44 extends through the hole 54 and is joined to the second enlarged head 52. A coil spring 56 is disposed between the head 52 and the first slide member 6 and biases an edge 58 of the shank portion 48 firmly against the bracket member 4 to hold the members 4, 6 together (FIG. 5).

Figure 6:
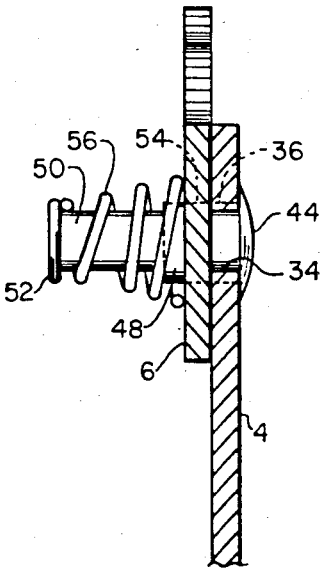
FIG. 6 is a sectional view, similar to FIG. 5, but showing the lock means in an alternative position.

If the slide member 6 is moved to the right, as viewed in FIGS. 1 and 3, to a point at which the second pin first enlarged shank portion 48 is in alignment with one of the slot enlarged portions 36, the shank portion 48 will be caused by the coil spring 56 to snap into the enlarged slot portion 36, to securely lock the bracket member 4 and the slide member 6 together (FIG. 6).

The first slide member 6 preferably is provided with a first grip portion 60 extending outwardly from the bracket member at an angle to the plane of the slide member planar portion 10.

Similarly, a third pin 62 (FIG. 3) is fixed to the second slide member 8, a shank portion 64 of the third pin 62 extending through the slot 34. The third pin 62 is provided with a head 66 (FIG. 4); larger than the width of the slot 34, to retain in a slidable mode the second slide member 8 upon the bracket member surface 12.

A fourth pin 68 is mounted for reciprocal movement in the assembly and includes a first enlarged head 70, a first enlarged shank portion 72, a second shank portion 74, and a second enlarged head 76. The fourth pin second shank portion 74 is disposed in a hole 78 in the second slide member 8. The fourth pin first enlarged shank portion 72 is larger in diameter than the width of the slot 34, but slightly smaller than the enlarged portion 36 of the slot 34. The second shank portion 74 of the pin 68 extends through the hole 78 and is joined to the second enlarged head 76. A coil spring 80 is disposed between the head 76 and the second slide member 8 and biases the pin 68 in the same manner as described above relative to the second pin 44.

The bracket member 4 is preferably provided with tab portions 81 integral with an end of the bracket member for engaging holes 83 in a support member 85 and thereby connecting the bracket member to the support member (FIG. 1).

The illustrative invention, as above described, is ideally suited for use in combination with shelves of the rigid wire type, with which the assembly is illustrated in FIGS. 1 and 2. As may be seen, the first notch 20 is adapted to receive a shelf first portion, such as a wire 82, and the second notch 30 is adapted to receive a shelf second portion, such as a wire 84. Upon manual depression of the heads 52, 76, the slide members 6, 8 are slidably moveable on the bracket member 4 to selectively determine the spacing between the first and second notches 20, 30. Upon releasing the heads 52, 76, the slide members are held against the bracket member by the force of the springs 56, 80, in a selected position, such that the first and second notches retain the shelf first and second portions, or wires 82, 84.

The pressure of the springs 56, 80 is sufficient to permit usage of the assembly for a variety of wire spacings. However, it is intended that the assembly be provided for use with shelving having known wire spacing. It is preferable that the spacing of two wires of the shelving coincide with the spacing of the first and second notches 20, 30 when the slide members 6, 8 are positioned on the bracket member such that the second and fourth pin enlarged shank portions 48, 72 are disposed, respectively, in one of the slot enlarged portions 36, thereby positively locking the members 4, 6 and 4, 8 together with the wires 82, 84 captured in the notches 20, 30.

It will be apparent that in the locked position, the shelf first wire 82, disposed in the first notch 20 is blocked by the first hook portion 18, including the leg portion 22, from moving in any but a first direction, away from the support member 85, and that the shelf second wire 84, disposed in the second notch 30, is blocked by the second hook portion 28, including the leg portion 32, from movement in any but a second direction, toward the support member 85. Thus, inadvertent dislodging of the shelf from the assembly is positively prevented.

If it is desired to change to a shelf having a different wire spacing, an operator need only depress the locking pin heads 52, 76 against the bias of the springs 56, 80, slide one or both of the slide members 6, 8 to a releasing position and remove the shelf. Wire portions of a new shelf can then be inserted between the notches 20, 30, the slide member 6 and/or slide member 8 moved to a position in which holding pressure is exerted on the wires disposed in the first and second notches, and locked in place by releasing the locking pin heads 52, 76; or, preferably, one or both of the slide members moved to a position in which the second and fourth pin shanks 48, 72 enter a slot enlarged portion 36, and locked in place by releasing the locking pin heads 52 and/or 76.

It is to be understood that the present invention is by no means limited to the particular construction herein disclosed and/or shown in the drawings, but also comprises any modifications or equivalents within the scope of the disclosure.

Having thus described my invention what I claim as new and desire to secure by Letters Patent of the United States is:

1. In combination, a bracket assembly and a shelf, said assembly comprising a main flat bracket member having a sloped upper surface sloping downwardly from the rear to the front thereof and having vertical attaching means on the rear end thereof, a first flat slide member mounted on said flat bracket member for movement therealong, said first flat slide member having an upstanding hook-like projection thereon defining a first notch to receive and overlie a first shelf portion, a second flat slide member mounted on said flat bracket member for movement therealong and having an upstanding hook-like projection thereon defining a second notch to receive and overlie a second shelf portion, said second notch being opposed to and in alignment with said first notch, said first and second slide members being slidably movable along said main bracket member toward and away from each other, said main bracket member being provided with a single elongated slot extending lengthwise thereof and running parallel to and spaced from said sloped upper surface, a first lock pin carried by said first slide member for securing said first slide member in a selected fixed position along said main flat bracket member, a second lock pin for securing said second flat slide member in a selected fixed position on said main bracket member, each of said first and second lock pins including a reciprocally movable and spring biased pin extending from its respective flat slide member and through said elongated slot, a portion of each of said pins on each slide member being adapted to be biased into position to lock its respective slide member in a selected position along said main flat bracket member, said elongated slot being provided with enlarged portions along the length thereof, each of said pins including a shank portion having a diameter greater than the width of said elongated slot in said main bracket member but less than the diameter of said enlarged slot portions, so that said shank portion may enter a selected one of said enlarged slot portions, and each of said lock pins including a helical spring means for biasing an edge portion thereof into engagement with said selected enlarged slot portion and against said main bracket member.

* * * * *